US006502282B1

(12) United States Patent
King

(10) Patent No.: US 6,502,282 B1
(45) **Date of Patent: *Jan. 7, 2003**

(54) APPARATUS FOR CONNECTING A CABINET DOOR HINGE TO A FRAMELESS CABINET WALL

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 147 days.

This patent is subject to a terminal disclaimer.

(21) Appl. No.: 09/689,328

(22) Filed: Oct. 12, 2000

Related U.S. Application Data

(63) Continuation-in-part of application No. 09/181,434, filed on Oct. 28, 1998, now Pat. No. 6,163,930.
(60) Provisional application No. 60/082,781, filed on Apr. 23, 1998.

(51) Int. Cl.[7] ..... E05D 5/00
(52) U.S. Cl. ..... 16/382; 16/252; 16/237; 16/388
(58) Field of Search ..... 16/382, 252, 271, 16/272, 388, 390, 236–238; 312/326–329; 411/427, 176, 160, 185–189

(56) References Cited

U.S. PATENT DOCUMENTS

| | | | | | |
|---|---|---|---|---|---|
| 3,590,419 | A | * | 7/1971 | Dargene | 16/235 |
| 4,177,540 | A | * | 12/1979 | Gorton | 16/237 |
| RE30,717 | E | | 8/1981 | Dargene | |
| 4,517,706 | A | | 5/1985 | Lautenschläger et al. | |
| 4,615,072 | A | | 10/1986 | Lautenschläger, Jr. et al. | |
| 4,698,877 | A | | 10/1987 | Lautenschläger, Jr. et al. | |
| 4,703,539 | A | | 11/1987 | Lautenschläger, Jr. et al. | |
| 4,704,766 | A | | 11/1987 | Almestad | |
| 4,799,290 | A | | 1/1989 | Lautenschläger, Jr. et al. | |
| 4,856,141 | A | | 8/1989 | Sassenberg | |
| 4,976,006 | A | | 12/1990 | Lautenschläger | |
| 5,052,077 | A | | 10/1991 | Lautenschläger, Jr. et al. | |
| 5,067,200 | A | | 11/1991 | Stowell et al. | |
| 5,103,532 | A | | 4/1992 | Youngdale et al. | |
| 5,108,165 | A | | 4/1992 | Rorke et al. | |
| 5,283,929 | A | * | 2/1994 | Lin | 16/237 |
| 5,327,616 | A | | 7/1994 | Lautenschläger, Jr. et al. | |
| 5,375,297 | A | | 12/1994 | Lautenschläger, Jr. et al. | |
| 5,392,493 | A | | 2/1995 | Youngdale | |
| 5,414,896 | A | * | 5/1995 | Domenig | 16/237 |
| 5,511,287 | A | | 4/1996 | Lautenschläger, Jr. et al. | |
| 5,517,724 | A | * | 5/1996 | Beneke | 16/278 |
| 5,577,296 | A | | 11/1996 | Grass | |
| 5,611,112 | A | * | 3/1997 | Rock et al. | 16/237 |
| 5,826,305 | A | * | 10/1998 | Domenig et al. | 16/235 |
| RE36,213 | E | | 6/1999 | Lautenschläger, Jr. et al. | |
| 6,163,930 | A | * | 12/2000 | King | 16/237 |
| 6,286,918 | B1 | * | 9/2001 | King | 16/382 |
| 6,353,966 | B1 | * | 3/2002 | King | 16/235 |

FOREIGN PATENT DOCUMENTS

| | | |
|---|---|---|
| DE | 4405349 A1 | 8/1995 |

OTHER PUBLICATIONS

Charles McMurray Catalog pp. 93 and 112–114.

* cited by examiner

*Primary Examiner*—Chuck Y. Mah
(74) *Attorney, Agent, or Firm*—Thomas R. Lampe

(57) ABSTRACT

A hinge support including an elongated support plate is used to support a hinge on a cabinet wall of a frameless cabinet. The support plate incorporates structure that allows the support plate to be used to mount different types of hinges and utilize different types of fasteners. A fastener member is positioned in an elongated recess formed in the cabinet wall and cooperates with the elongated support plate to exert clamping forces on the cabinet wall to maintain the support plate in position.

30 Claims, 4 Drawing Sheets

APPARATUS FOR CONNECTING A CABINET DOOR HINGE TO A FRAMELESS CABINET WALL

This application is a continuation-in-part of U.S. patent application Ser. No. 09/181,434, filed Oct. 28, 1998 now U.S. Pat. No. 6,163,930, which claims the benefit of Provisional application Ser. No. 60/082,781, field Apr. 23, 1998.

TECHNICAL FIELD

This invention relates to frameless cabinets and more particularly to apparatus for connecting a cabinet door hinge to a cabinet wall of a frameless cabinet.

BACKGROUND OF THE INVENTION

Frameless cabinet constructions having cabinet walls with doors hingedly connected thereto are well known. German Offenlegungsschrift DE 4405349A1 discloses a structural wall having a recess extending from a front opening into the interior of the wall. The recess communicates with a slot formed in a wall side. A hinge member having flanges is connected to the wall structure by positioning the flanges in the recess and the hinge member per se in the slot communicating with the recess.

U.S. Pat. No. 5,067,200, issued Nov. 26, 1991, shows a hinge suitable for use with cabinets having inset doors. The hinge can be installed and adjusted on the door at the installation site. The hinge has hinge wings which are concealed when the door is in the closed position. The hinge includes a clamping plate parallel to a leg of a door wing engageable in a slot in the slotted edge of the door.

The following prior art also is known and believed representative of the current state of the prior art:

U.S. Pat. No. 5,511,287, issued Apr. 30, 1996, U.S. Pat. No. 4,799,290, issued Jan. 24, 1989, U.S. Pat. No. 4,856,141, issued Aug. 15, 1989, U.S. Pat. No. 5,327,616, issued Jul. 12, 1994, U.S. Pat. No. 5,375,297, issued Dec. 27, 1994, U.S. Pat. No. 5,108,165, issued Apr. 28, 1992, U.S. Pat. No. RE. 36.213, issued Jun. 1, 1999, U.S. Pat. No. RE.30,717, issued Aug. 25, 1981, U.S. Pat. No. 5,052,077, issued Oct. 1, 1991, U.S. Pat. No. 4,615,072, issued Oct. 7, 1986, U.S. Pat. No. 4,517,706, issued May 21, 1985, U.S. Pat. No. 4,698,877, issued Oct. 13, 1987, U.S. Pat. No. 5,392,493, issued Feb. 28, 1995, U.S. Pat. No. 5,577,296, issued Nov. 26, 1996, U.S. Pat. No. 5,103,532, issued Apr. 14, 1992, U.S. Pat. No. 4,704,766, issued Nov. 10, 1987, and U.S. Pat. No. 4,976,006, issued Dec. 11, 1990. A frameless cabinet door hinge is disclosed in German Offenlegungsschrift DE 4405349A1. Other hinges of some degree of relevance are shown in pages 93 and 112–114 of the 1998 Charles McMurray Catalog.

The prior art indicated above does not teach or suggest the invention disclosed and claimed herein.

DISCLOSURE OF INVENTION

The present invention relates to apparatus for connecting a cabinet door hinge to a cabinet wall of a frameless cabinet. The apparatus provides a means whereby a variety of different hinges can be attached to the wall; that is, the invention is of a universal character, providing a simple and relatively low cost approach to installation of door hinges of various types to frameless cabinets. The installation is quickly and easily accomplished and the resultant construction is strong and reliable.

According to the invention, a hinge support including an elongated support plate having a distal end is connected to a cabinet wall by first fastener means.

The cabinet wall includes spaced inner and outer wall sides and a wall front extending between the inner and outer wall sides. The cabinet wall defines an opening of predetermined size in the inner wall side spaced from the wall front.

An elongated recess spaced from the wall front communicates with the opening and extends rearwardly from the opening between the wall sides.

An elongated slot is formed in the inner side wall extending along the elongated recess and communicating therewith.

The opening has a vertical dimension greater than the vertical dimension of the elongated recess and the elongated recess has a vertical dimension greater than the vertical dimension of the elongated slot.

The first fastener means which connects the elongated support plate to the cabinet wall comprises a threaded bolt extending from the elongated support plate into the elongated slot at a location spaced from the opening and a fastener member disposed in the elongated recess and releasably threadedly engaged with the bolt.

A portion of the cabinet wall defining the elongated slot is clampingly engaged between the elongated support plate and the fastener member.

Second fastener means releasably connects the second hinge member of a hinge including a first hinge member for attachment to a cabinet door and a second hinge member pivotally connected thereto to the support plate.

Other features, advantages, and objects of the present invention will become apparent with reference to the following description and accompanying drawings.

MODES FOR CARRYING OUT THE INVENTION

Figure 4:
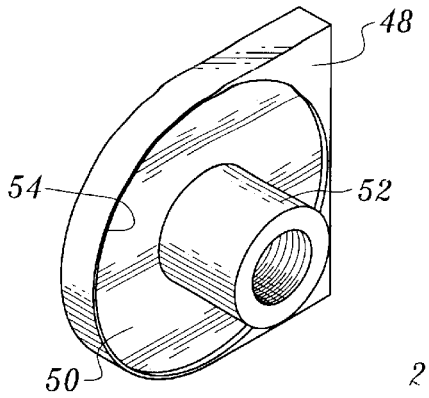
FIG. 4 is an enlarged, perspective view of a fastener member employed to mount the support plate.

Referring now to FIGS. 1–11, a preferred embodiment of the invention is illustrated.

According to the invention, a support plate 10 having a distal end 12 is mounted on a cabinet wall 14 of a frameless cabinet.

The support plate 10 will, as described in more detail below, be employed to support a hinge 18 connected to a cabinet door 20.

The cabinet wall 14 includes spaced inner and outer wall sides 22, 24, respectively, and a wall front 26 extending between the inner and outer wall sides.

The cabinet wall defines a circular opening 30 of predetermined size in the inner wall side spaced from the front wall. An elongated recess 32 spaced from the front wall communicates with the opening 30 and extends rearwardly or inwardly from the opening between the wall sides. An elongated slot 34 is formed in the inner wall side extending along the elongated recess and communicating therewith.

The opening has a vertical dimension greater than the vertical dimension of the elongated recess and the elongated recess has a vertical dimension greater than the vertical dimension of the elongated slot.

The elongated support plate distal end 12 has an aperture 38 formed therein. The elongated support plate is of a length exceeding the combined lengths of the opening 30 and the elongated slot 34. When installed on the cabinet door, the elongated support plate completely covers the opening and the elongated slot.

Fastener means is employed to connect the elongated support plate to the cabinet wall. The fastener means comprises a threaded bolt 46 projecting through aperture 38 and a fastener member threadedly engaged with the bolt. The fastener member includes a fastener plate 48 having a planar surface 50 and an internally threaded boss 52 extending outwardly from the planar surface. A generally circular projection in the form of a rib member 54 extends about the boss 52 and projects in the same direction as the boss.

Figure 1:
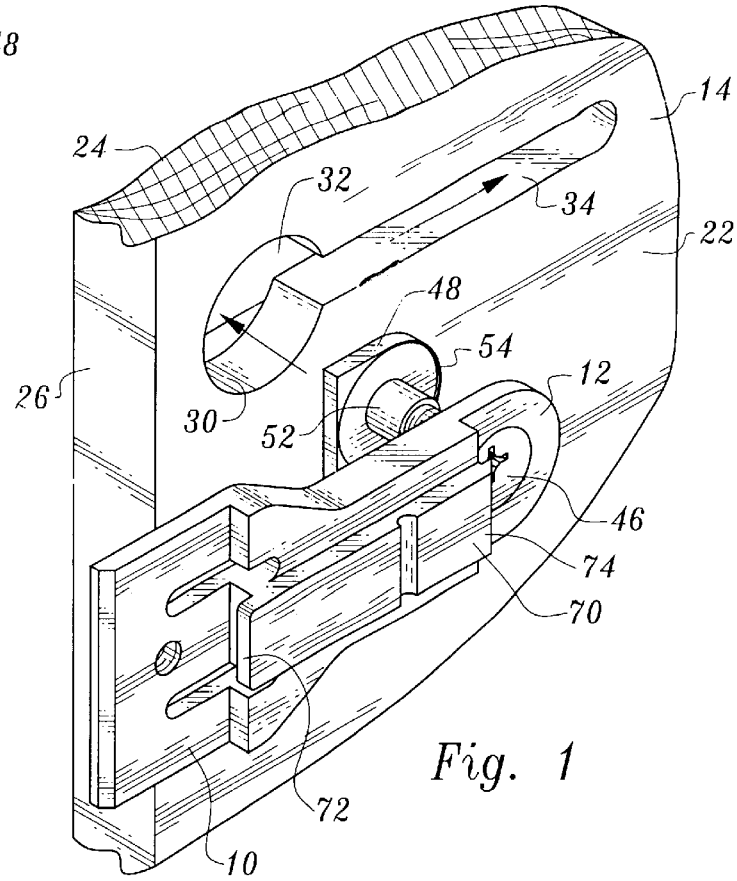
FIG. 1 is a perspective view of a preferred embodiment of the present invention depicting a cabinet wall of a frameless cabinet and a hinge support including an elongated support plate being positioned for mounting on the cabinet wall along with fastener means employed in connection with the mounting procedure.
Figure 2:
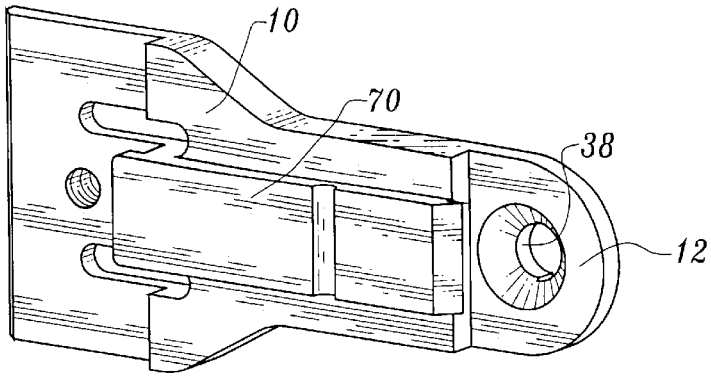
FIG. 2 is an enlarged, perspective view of the outer side of the elongated support plate.
Figure 3:
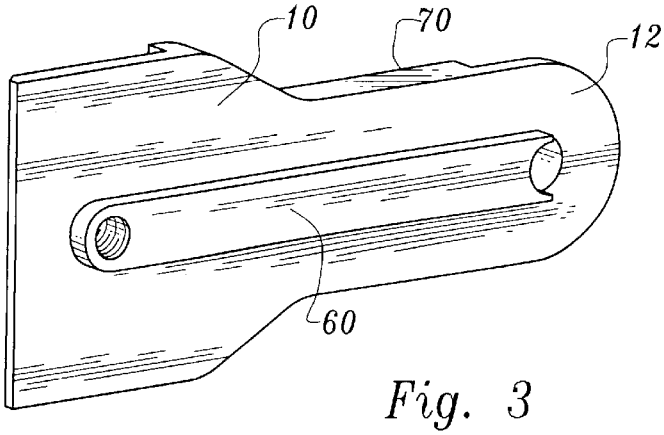
FIG. 3 is an enlarged, perspective view of the back side of the support plate.
Figure 5:
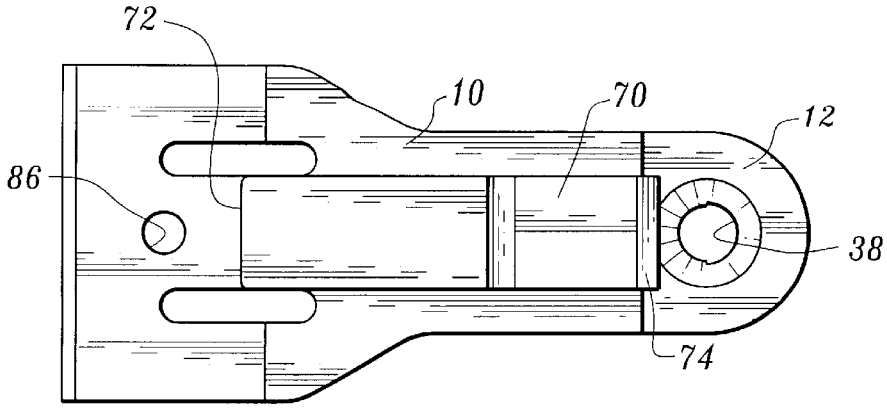
FIG. 5 is an enlarged, elevational view illustrating the front side of the support plate.
Figure 6:
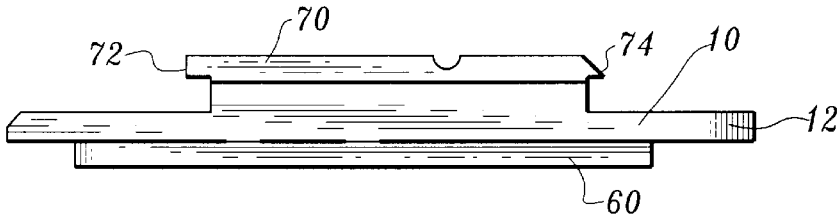
FIG. 6 is a top plan view of the support plate.
Figure 7:
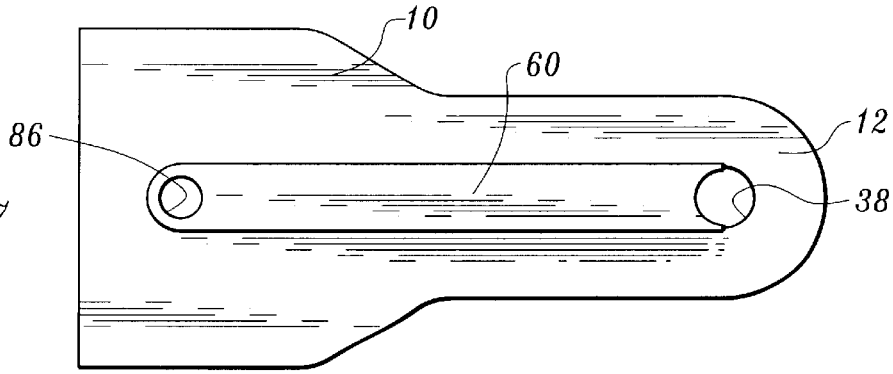
FIG. 7 is an elevational view of the back side of the support plate.

FIG. 1 shows the fastener member threadedly engaged with bolt 46 projecting inwardly from elongated support plate 10. Attachment of the elongated support plate and associated structure is simplicity itself. The installer inserts the fastener member into opening 30, the opening being sized to allow ready insertion or removal of the fastener member. The insertion of the fastener member may take place with the fastener member connected to the support plate as shown in FIG. 1 or by itself. If this latter approach is followed, the bolt 46 is screwed into the boss to secure the fastener member to the support plate after insertion of the fastener member into the opening.

Figure 8:
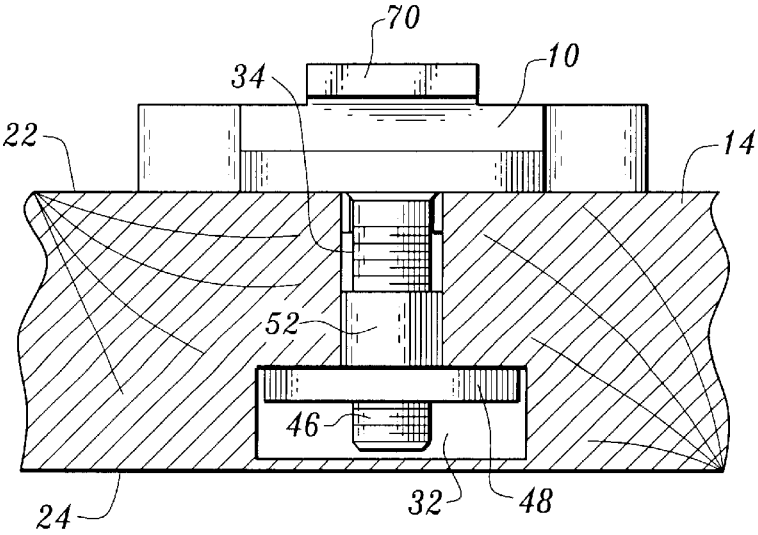
FIG. 8 is a greatly enlarged end view of the support plate illustrating the support plate mounted on the cabinet wall by the fastener member, the cabinet wall being shown in cross-section.
Figure 11:
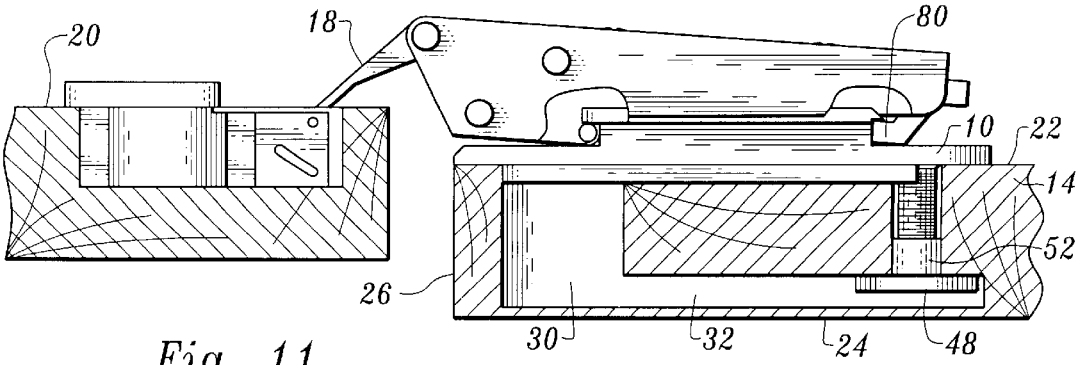
FIG. 11 is a top plan view of the connected hinge and support plate in operative position relative to a portion of the cabinet wall and a portion of the cabinet door, the latter two structures being shown in cross-section.

After the fastener member is situated in the opening, it is lined up with elongated recess 32, the rounded end of the fastener member oriented toward the far end of the recess, as shown. The fastener member is then moved to the desired location, as illustrated in FIGS. 8 and 11 for example, and the bolt 46 is then turned to cause clamping engagement of the portion of the cabinet wall defining the elongated slot 34 to secure the distal end of the elongated support plate in position. Because the vertical dimension of the recess 32 is less than the maximum outer peripheral dimension of the fastener plate 48, the plate will engage the cabinet wall to prevent turning of the fastener plate during the tightening operation.

When the fastener plate 48 is drawn toward the portion of the cabinet wall forming slot 34 during the clamping operation, the rib member 54 will "bite" into the cabinet wall to increase structural stability and integrity at that location.

In the disclosed embodiment of the invention an elongated projection 60 projects from the inner face of the support plate closely adjacent to aperture 38. Projection 60 projects into elongated slot 36 when the support plate is fastened into position by bolt 46 and the fastener member to stabilize the support plate and prevent rotation thereof.

Integrally formed with elongated support plate 10 and extending outwardly from the outer side thereof is a protrusion 70 having spaced ends 72, 74 defining recesses over the elongated support plate. This protrusion cooperates with a clamp 80 attached to the hinge member not directly attached to the cabinet door to releasably connect the hinge to the support plate. Use of a clamp and protrusion to releasably attach a hinge is known per se, an example being the connector assembly incorporated in the DSM29-270Z/0 hinge made available by Mepla. In a typical prior art installation a protrusion generally corresponding in shape to that of protrusion 70 is affixed to the inner surface of a cabinet wall or other structure by wood screws or the like. This is not a strong installation, particularly when the cabinet wall is relatively thin or constructed of weak material.

Figure 9:
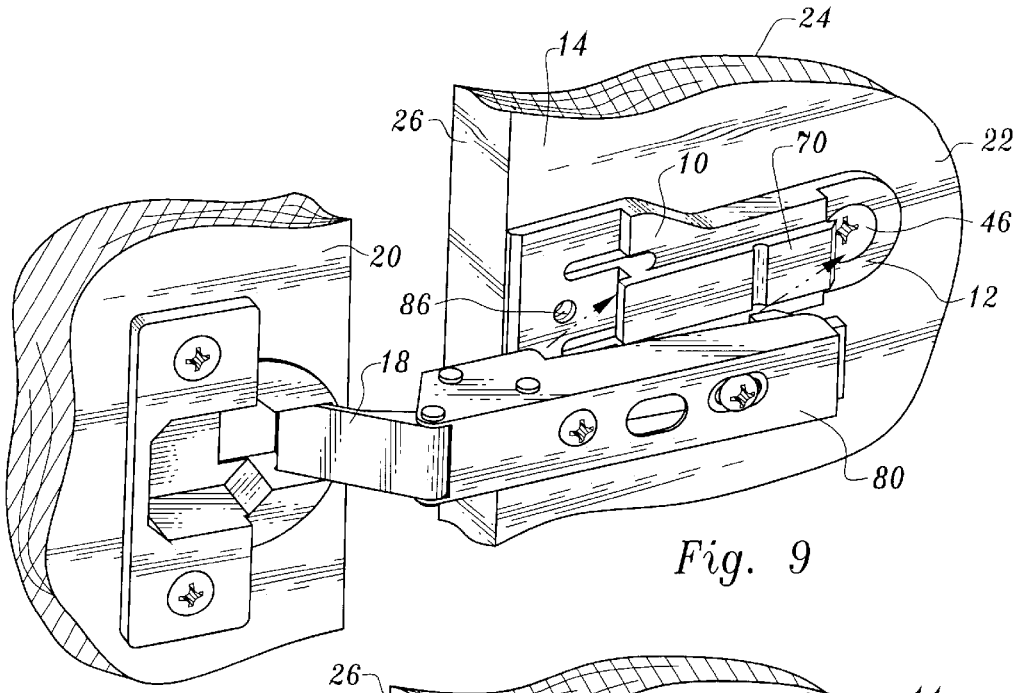
FIG. 9 is a perspective view illustrating a portion of a cabinet door having a hinge attached thereto prior to connection of the hinge to the support plate.
Figure 10:
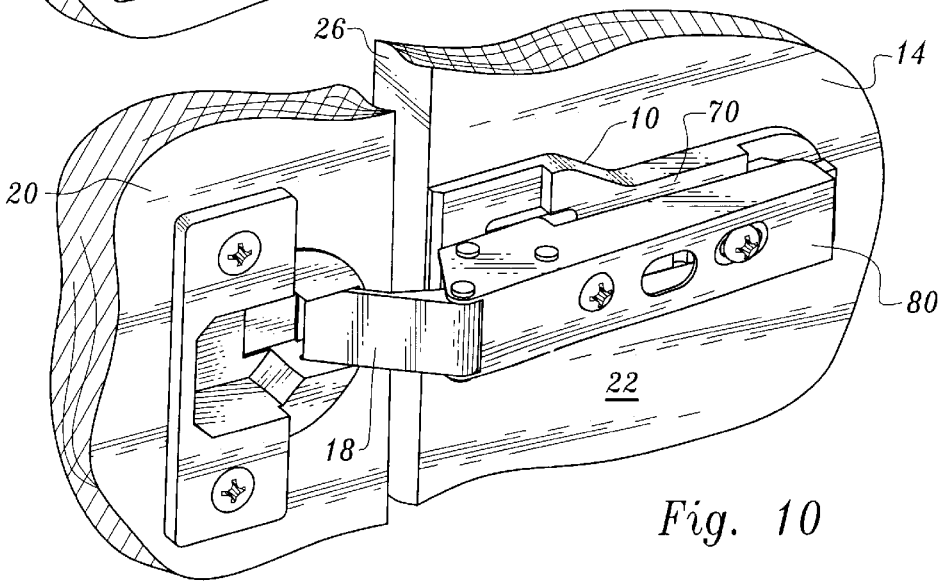
FIG. 10 is a view similar to FIG. 9 but illustrating the hinge attached to the support plate.
Figure 12:
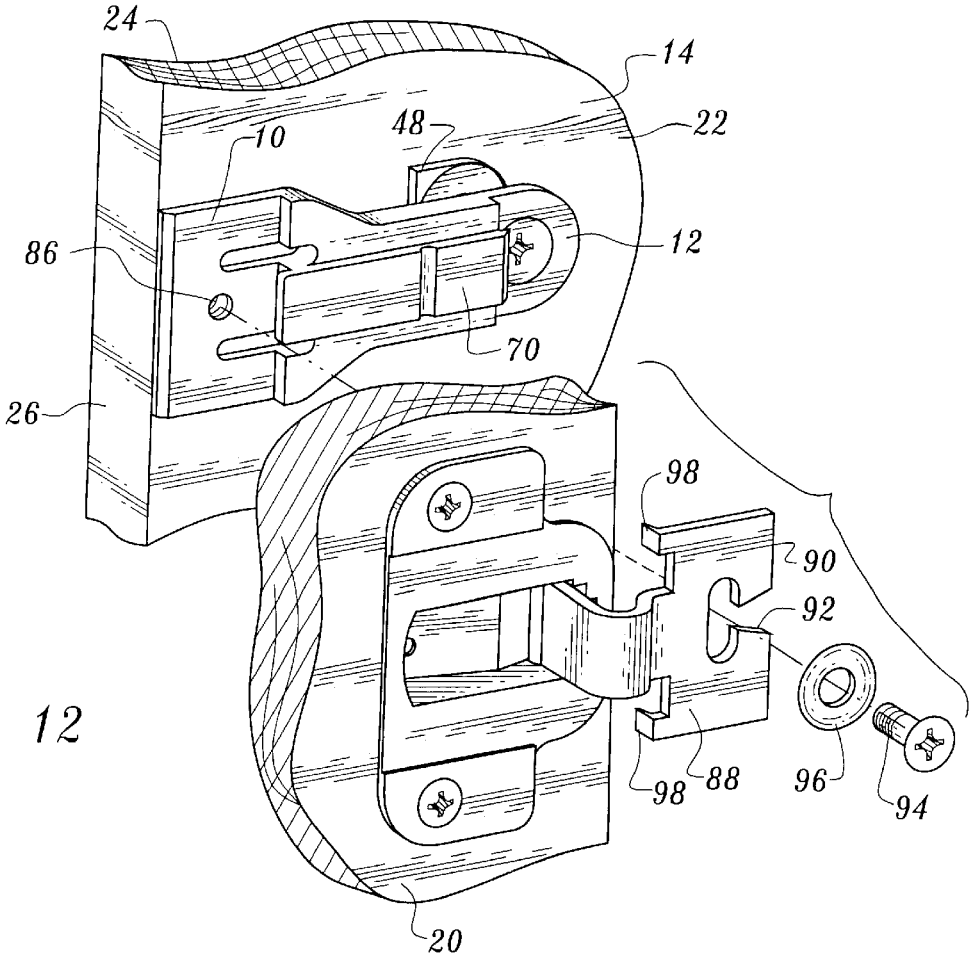
FIG. 12 is a perspective, exploded view illustrating an alternate form of hinge and hinge fastener prior to attachment thereof to the support plate.
Figure 13:
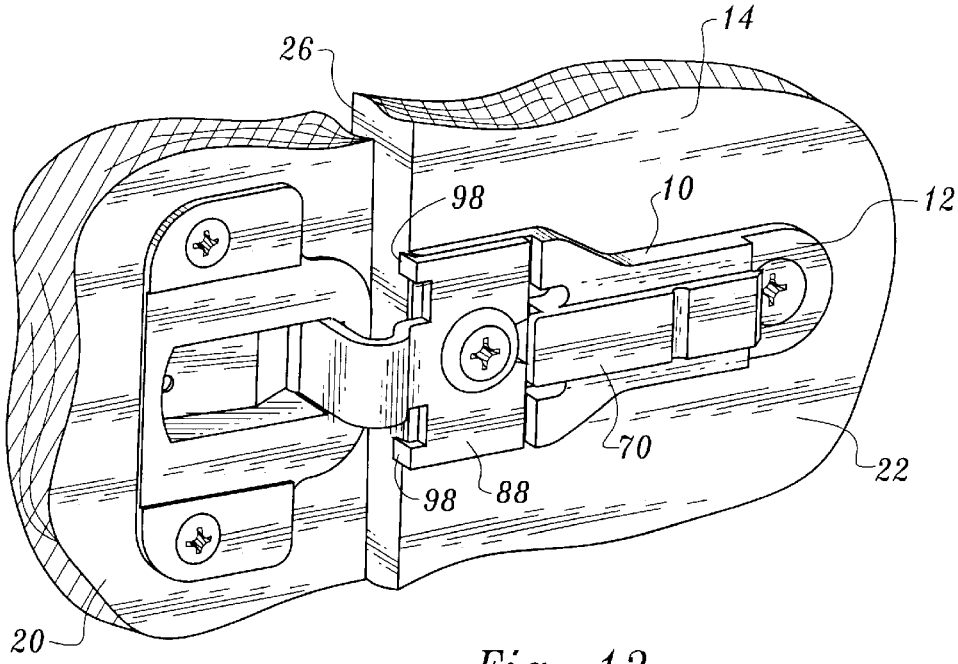
FIG. 13 is a view similar to FIG. 10, but illustrating the alternate form of hinge attached to the support plate, the support plate being mounted on a cabinet wall.

The elongated support plate is so constructed as to allow hinges of types other than that shown in FIGS. 9 and 10 to be utilized. Support plate 10 defines an opening 86 at the end thereof spaced from distal end 12. Referring now to FIGS. 12 and 13, a different type of hinge construction is utilized. In this arrangement, a hinge member plate 88 having an outer edge 90 comprises a portion of one of the hinge members. Hinge member plate 88 defines an opening 92 extending to the edge 90 for receiving a threaded fastener 94 which enters opening 86 and is employed, along with a washer 94, to secure hinge member plate 88 to the elongated support plate 10. The hinge member plate 88 has tabs or stops 98 associated therewith to engage wall front 26 to properly position the hinge relative to the cabinet wall.

The invention claimed is:

1. In combination:

a cabinet wall of a frameless cabinet, said cabinet wall including spaced inner and outer wall sides and a wall front extending between said inner and outer wall sides, said cabinet wall defining an opening of predetermined size in said inner wall side spaced from said wall front, an elongated recess spaced from said wall front communicating with said opening extending rearwardly from said opening between said wall sides and an elongated slot formed in said inner wall side extending along said elongated recess and communicating therewith, said opening having a vertical dimension greater than the vertical dimension of said elongated recess and said elongated recess having a vertical dimension greater than the vertical dimension of said elongated slot;

a hinge support including an elongated support plate having a distal end;

first fastener means connecting said elongated support plate to said cabinet wall, said first fastener means comprising a threaded bolt extending from the elongated support plate into the elongated slot at a location spaced from said opening and a fastener member disposed in said elongated recess and releasably threadedly engaged with said bolt, a portion of the cabinet wall defining said elongated slot clampingly engaged between said elongated support plate and said fastener member;

a hinge including a first hinge member for attachment to a cabinet door and a second hinge member pivotally connected to said first hinge member; and second fastener means releasably connecting said second hinge member to said support plate.

2. The combination according to claim 1 wherein said fastener member includes a fastener plate bearing against said portion of said cabinet wall defining said elongated slot and a threaded boss projecting from the fastener plate into said elongated slot, said boss being sized to allow slidable movement of said boss within said elongated slot when said elongated support plate and said fastener member are unclamped from said portion of said cabinet wall defining said elongated slot.

3. The combination according to claim 2 wherein said fastener plate is sized to permit selective positioning of said fastener plate into said opening or removal of said fastener plate from said opening.

4. The combination according to claim 2 wherein said fastener plate includes at least one projection oriented toward said elongated support plate and pressed into said portion of said cabinet wall defining said elongated slot.

5. The combination according to claim 4 wherein said at least one projection comprises a rib member substantially surrounding said threaded boss and projecting in the same direction as said threaded boss.

6. The combination according to claim 5 wherein said rib member is generally circular and disposed closely adjacent to the outer periphery of said fastener plate.

7. The combination according to claim 2 wherein the vertical dimension of said recess is less than the maximum cross-sectional dimension of said fastener plate whereby complete rotation of said fastener plate in said recess is prevented.

8. The combination according to claim 1 additionally comprising stabilizer means for preventing rotation of said elongated support plate relative to said cabinet wall when said portion of the cabinet wall defining said elongated slot is clampingly engaged between said elongated support plate and said fastener member.

9. The combination according to claim 8 wherein said stabilizer means comprises a projection affixed to said elongated support plate adjacent to said threaded bolt and extending into said elongated slot and engaging the portion of the cabinet wall defining said elongated slot.

10. The combination according to claim 1 wherein said second fastener means comprises a protrusion affixed to and extending outwardly from said elongated support plate and a clamp attached to said second hinge member releasably clampingly engaging said protrusion.

11. The combination according to claim 1 wherein said second fastener means comprises a threaded fastener interconnecting said second hinge member and said elongated support plate.

12. The combination according to claim 11 wherein said second hinge member includes a hinge member plate having an outer edge, said hinge member plate defining an opening extending to said edge for receiving said threaded fastener.

13. The combination according to claim 1 wherein said hinge support comprises a universal hinge support allowing selective alternate attachment of different types of hinges to said elongated support plate.

14. The combination according to claim 13 additionally comprising a protrusion extending outwardly from said elongated support plate for clamping engagement by a clamp operatively associated with a hinge and wherein said elongated support plate defines an aperture spaced from said protrusion for receiving a threaded fastener operatively associated with a hinge.

15. The combination according to claim 1 wherein the length of said elongated support plate exceeds the combined length of said opening and said elongated slot and wherein said elongated support plate completely covers said opening and said elongated slot.

16. The combination according to claim 1 wherein said fastener means is located closely adjacent to the distal end of said elongated support plate.

17. Apparatus for connecting a hinge having pivotally connected first and second hinge members to a cabinet wall of a frameless cabinet, said cabinet wall including spaced inner and outer wall sides and a wall front extending between said inner and outer wall sides, said cabinet wall defining an opening of predetermined size in said inner wall side spaced from said wall front, an elongated recess spaced from said wall front communicating with said opening extending rearwardly from said opening between said wall sides and an elongated slot formed in said inner wall side extending along said elongated recess and communicating therewith, said opening having a vertical dimension greater than the vertical dimension of said elongated recess and said elongated recess having a vertical dimension greater than the vertical dimension of said elongated slot, said apparatus comprising, in combination:

a hinge support including an elongated support plate;

first fastener means for connecting said elongated support plate to said cabinet wall, said first fastener means comprising a threaded bolt extending from the elongated support plate into the elongated slot at a location spaced from said opening when said elongated support plate is connected to said cabinet wall and a fastener member positionable in said elongated recess and releasably threadedly engaged with said bolt, a portion of the cabinet wall defining said elongated slot clampingly engageable between said elongated support plate and said fastener member; and second fastener means for releasably connecting the second hinge member of a hinge to said support plate.

18. The apparatus according to claim 17 wherein said fastener member includes a fastener plate and a threaded boss projecting from the fastener plate, said boss being sized to allow slidable movement of said boss within the elongated slot formed in said cabinet wall when said elongated support plate and said fastener member are unclamped from said portion of said cabinet wall defining said elongated slot.

19. The combination according to claim 18 wherein said fastener plate is sized to permit selective positioning of said fastener plate into said opening or removal of said fastener plate from said opening.

20. The combination according to claim 18 wherein said fastener plate includes at least one projection oriented toward said elongated support plate for pressing into said portion of said cabinet wall defining said elongated slot.

21. The combination according to claim 20 wherein said at least one projection comprises a rib member substantially surrounding said threaded boss and projecting in the same direction as said threaded boss.

22. The combination according to claim 21 wherein said rib member is generally circular and disposed closely adjacent to the outer periphery of said fastener plate.

23. The combination according to claim 17 additionally comprising stabilizer means for preventing rotation of said elongated support plate relative to said cabinet wall when said portion of the cabinet wall defining said elongated slot is clampingly engaged between said elongated support plate and said fastener member.

24. The combination according to claim 23 wherein said stabilizer means comprises a projection affixed to said elongated support plate adjacent to said threaded bolt for extending into said elongated slot and engaging the portion of the cabinet wall defining said elongated slot.

25. The combination according to claim 17 wherein said second fastener means comprises a protrusion affixed to and extending outwardly from said elongated support plate for releasable clamping engagement by a clamp on the second hinge member of a hinge.

26. The combination according to claim 17 wherein said second fastener means comprises a threaded fastener for interconnecting said second hinge member and said elongated support plate.

27. The combination according to claim 17 wherein said hinge support comprises a universal hinge support allowing selective alternate attachment of different types of hinges to said elongated support plate.

28. The combination according to claim 27 additionally comprising a protrusion extending outwardly from said elongated support plate for clamping engagement by a clamp operatively associated with a hinge and wherein said elongated support plate defines an aperture spaced from said protrusion for receiving a threaded fastener operatively associated with a hinge.

29. The combination according to claim 17 wherein the length of said elongated support plate exceeds the combined length of said opening and said elongated slot whereby said elongated support plate will completely cover said opening and said elongated slot.

30. The combination according to claim 17 wherein said fastener means is located closely adjacent to a distal end of said elongated support plate.

* * * * *